US006622759B2

(12) United States Patent
Yang

(10) Patent No.: US 6,622,759 B2
(45) Date of Patent: Sep. 23, 2003

(54) BALLOON NECK FITTING

(76) Inventor: I Chiang Yang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/037,354

(22) Filed: Jan. 7, 2002

(65) Prior Publication Data

US 2003/0127156 A1 Jul. 10, 2003

(51) Int. Cl.[7] ..... A63H 3/06

(52) U.S. Cl. ..... 141/114; 141/313; 446/220; 446/224

(58) Field of Search ..... 141/67, 114, 313, 141/314, 316, 317; 446/220–226; 53/258, 260–263, 385.1, 390, 434, 459

(56) References Cited

U.S. PATENT DOCUMENTS 3,692,071 A * 9/1972 Begleiter ..... 141/313
4,094,347 A * 6/1978 Ikemoto ..... 141/313
4,687,458 A * 8/1987 Handa ..... 446/222
4,701,148 A * 10/1987 Cotey ..... 446/224

* cited by examiner

*Primary Examiner*—J. Casimer Jacyna
(74) *Attorney, Agent, or Firm*—Charles E. Baxley

(57) ABSTRACT

A balloon neck fitting includes a check valve section having a peripheral housing and a peripheral flange extended radially outward from the peripheral housing for engaging with a larger balloon. The housing includes a chamber for receiving a gas supplying nozzle, and one or more extensions engaged with the neck of the balloons. Another housing is formed on top of the housing and having an outer diameter smaller than that of the housing for engaging with a neck of a smaller balloon, and for allowing the smaller balloon to be inflated and received in the larger balloon.

7 Claims, 8 Drawing Sheets

BALLOON NECK FITTING

BACKGROUND OF THE INVENTION

1. Field of the Invention

The present invention relates to a balloon neck fitting, and more particularly to a balloon neck fitting for effectively inflating balloons.

2. Description of the Prior Art

U.S. Pat. No. 4,094,347 to Ikemoto discloses one of the typical balloon neck fittings and comprises a check valve section and a guide section joined together and detachable from each other after the balloons have been inflated. The check valve section includes a cylindrical shape having a lateral wall, and having several gas passage holes formed in the lateral wall for filling air or gas into the balloons. The necks of the balloons have a large portion or area engaged with the cylindrical lateral wall of the check valve section, and thus may not be solidly or firmly engaged with or sealed to the cylindrical lateral wall of the check valve section, and thus the air or the gas may be easily or may have a good chance to be leaked between the large contact area between the necks of the balloons and the cylindrical lateral wall of the check valve section.

The present invention has arisen to mitigate and/or obviate the afore-described disadvantages of the conventional balloon neck fittings.

SUMMARY OF THE INVENTION

The primary objective of the present invention is to provide a balloon neck fitting including a check valve section having a reduced contact area for engaging with the neck of the balloon and for preventing air or gas from leaking between the neck of the balloon and the check valve section.

The other objective of the present invention is to provide a balloon neck fitting including a check valve section having a reduced contact area for engaging with the neck of the balloon and for reducing the noise while filling air or gas into the neck of the balloon.

In accordance with one aspect of the invention, there is provided a balloon neck fitting comprising a check valve section including a peripheral housing having a middle portion, and having a peripheral flange extended radially outward from the middle portion thereof for engaging with a neck of a balloon, the housing includes a chamber formed therein, and includes an upper portion having one or more extensions extended outward therefrom, the extensions each including an orifice formed therein and communicating with the chamber of the housing, and each including an outer end for engaging with the neck of the balloon, and for reducing a contact area with the necks of the balloons respectively.

The balloon neck fitting may further include a smaller housing formed on top of the housing and having an outer diameter smaller than that of the housing for engaging with a neck of a smaller balloon, and for allowing the smaller balloon to be inflated and received in a greater or larger balloon.

The housings each includes a middle portion having a peripheral flange extended radially outward therefrom. The housings each includes one or more extensions extended outward therefrom for engaging with the necks of the balloons, and each having an orifice formed therein and communicating with the chamber of the housings respectively.

The extensions of the housings each includes an outer end for engaging with the necks of the balloons respectively, and each includes a peripheral ring formed on the outer end thereof for reducing a contact area with the necks of the balloons respectively.

The housings each includes a peripheral board provided on top thereof, and spaced from the peripheral flange thereof, for forming a peripheral channel between the peripheral board and the peripheral flange respectively.

A base is further provided and includes an upper portion coupling to the first housing with a coupling member, the coupling member is breakable for allowing the base to be disengaged from the first housing when the balloons have been inflated.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
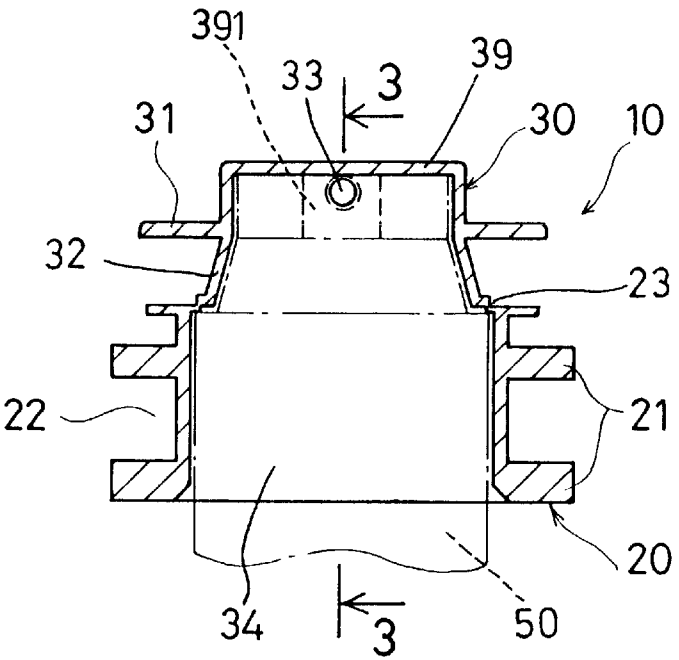
FIG. 2 is a cross sectional view taken along lines 2—2 of FIG. 1.
Figure 1:
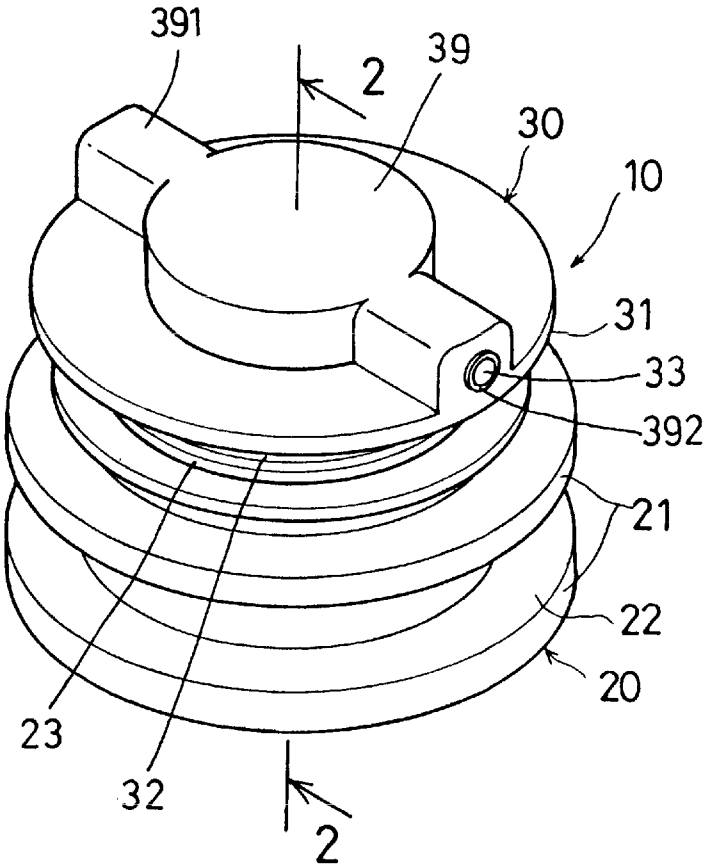
FIG. 1 is a perspective view of a balloon neck fitting in accordance with the present invention.
Figure 3:
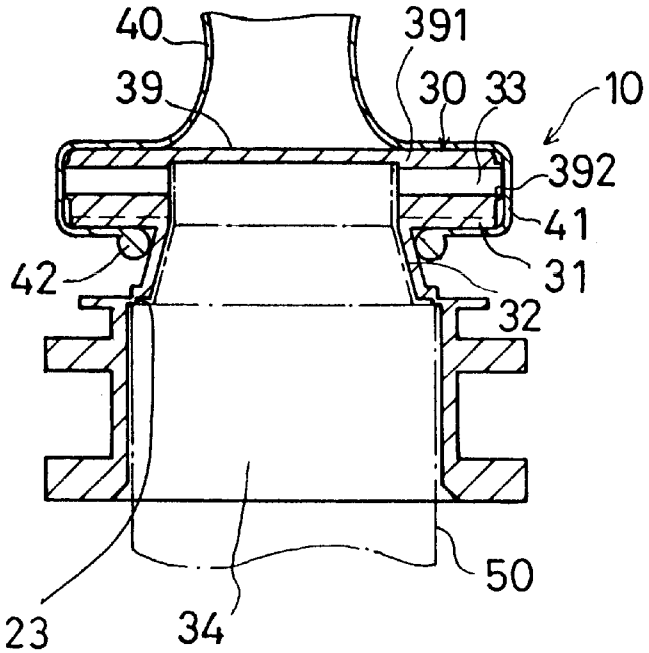
FIG. 3 is a cross sectional view taken along lines 3—3 of FIG. 2.

Referring to the drawings, and initially to FIGS. 1–3, a balloon neck fitting 10 in accordance with the present invention comprises a base 20, and a check valve section 30 provided or formed on the base 20 with plastic materials, by such as a molding or mold injection process, or the like, and a chamber 34 formed in the base 20 and/or the check valve section 30 for receiving a gas supplying nozzle 50. The base 20 includes one or more peripheral flaps 21 extended radially outward therefrom for forming or defining one or more peripheral channel 22 in the outer peripheral portion thereof, and for allowing the base 20 to be firmly and solidly held by the users. The check valve section 30 may be joined to or secured to the base 20 with a peripheral coupling member 23 that may be bent or broken for allowing the check valve section 30 to be disengaged from the base 20 after the balloon 40 has been filled with air or gas, best shown in FIG. 5.

The check valve section 30 of the balloon neck fitting 10 includes a cylindrical or a peripheral housing 32 having a peripheral flange 31 laterally extended radially outward therefrom, and having an upper wall 39 formed on top thereof. One or more extensions 391 are extended outward from the upper portion of the cylindrical housing 32 and disposed or located above the peripheral flange 31 and include an outer or free end flush with the outer peripheral portion of the peripheral flange 31. For example, two extensions 391 are oppositely extended from the housing 32. The extensions 391 each includes an orifice 33 formed therein and communicating with the chamber 34 of the base 20 and the check valve section 30. The neck 41 of the balloon 40 may be engaged onto the extensions 391 and the peripheral flange 31 for blocking the orifices 33 of the extensions 391, and includes a peripheral bead 42 engaged with the bottom portion of the peripheral flange 31 and the outer peripheral portion of the cylindrical housing 32, best shown in FIGS. 3 and 4.

Figure 4:
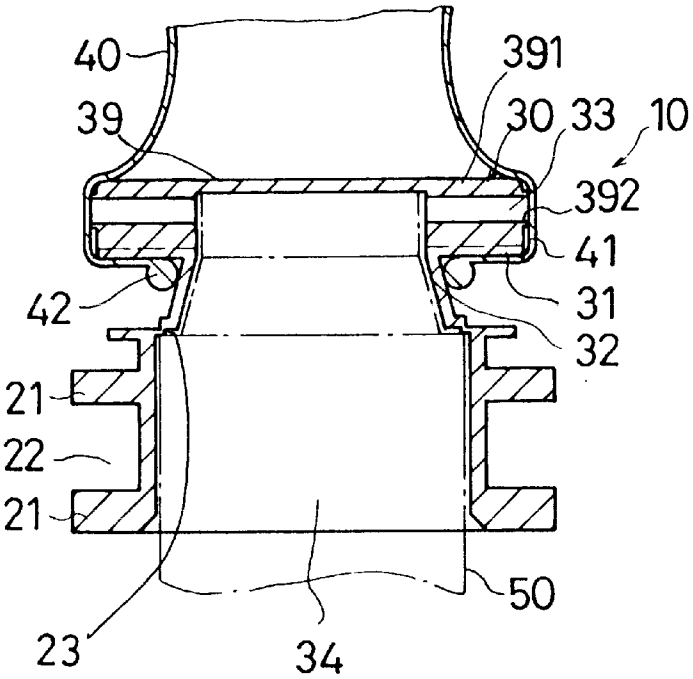
FIG. 4 is a cross sectional view similar to FIG. 3, illustrating the operation of the balloon neck fitting.

As best shown in FIGS. 1, 3, and 4, the extensions 391 each includes a peripheral rib or ring 392 formed and provided on the outer or free end thereof and slightly extended outward from the extensions 391 respectively, and formed around the orifice 33 thereof for engaging with the neck 41 of the balloon 40, and for reducing the engaging area with the neck 41 of the balloon 40.

Figure 5:
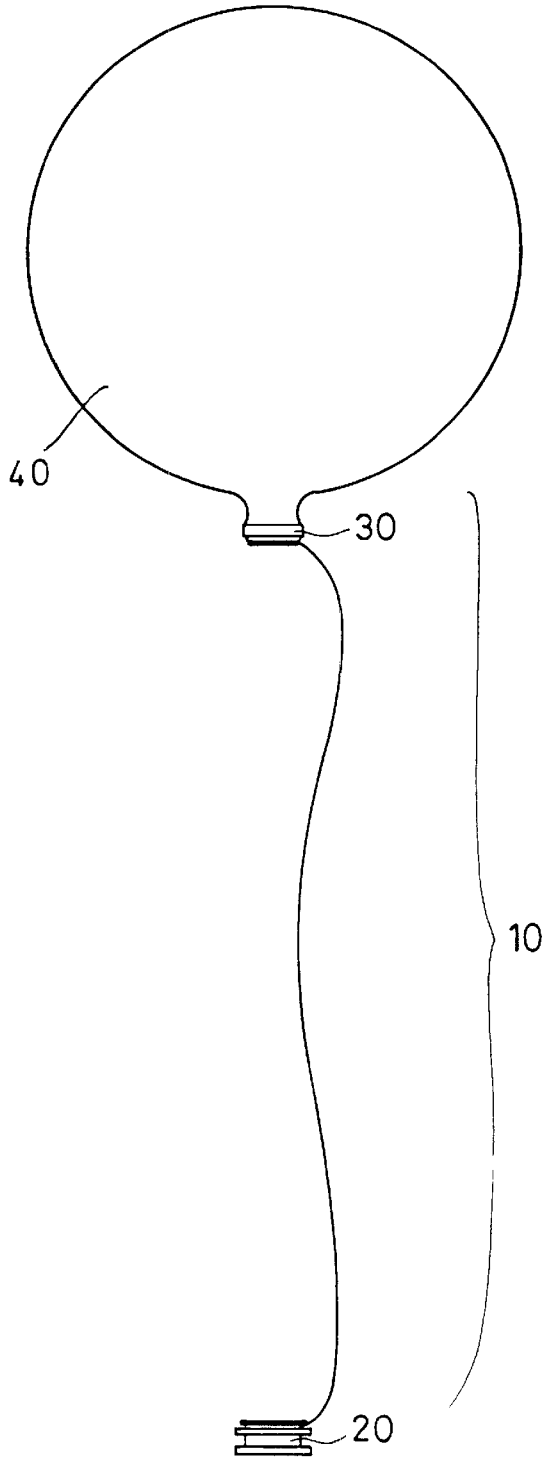
FIG. 5 is a plan schematic view illustrating the operation of the balloon neck fitting.
Figure 7:
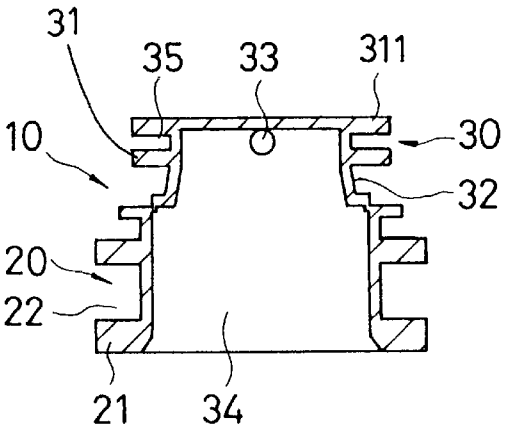
FIG. 7 is a cross sectional view taken along lines 7—7 of FIG. 6.
Figure 6:
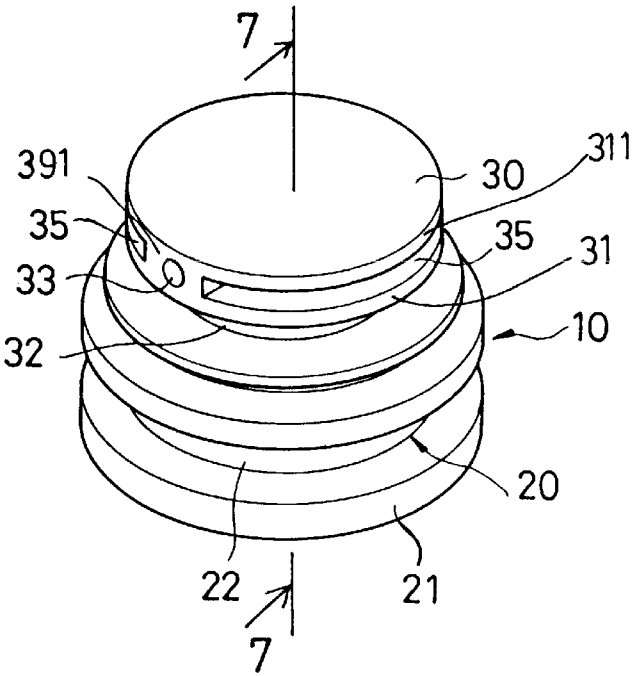
FIG. 6 is a perspective view illustrating the other embodiment of the balloon neck fitting.
Figure 8:
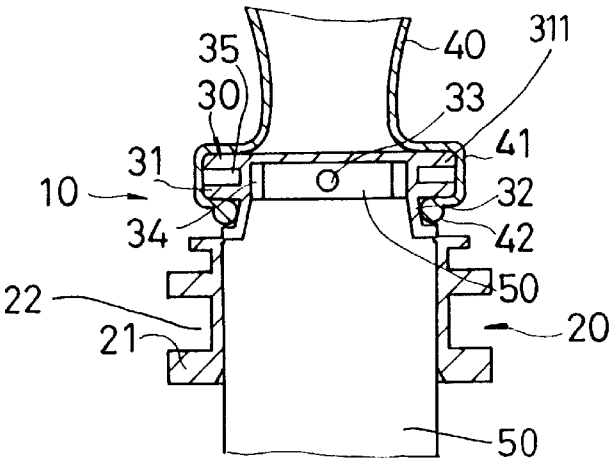
FIGS. 8 and 9 are cross sectional views similar to FIG. 7, illustrating the operation of the balloon neck fitting as shown in FIGS. 6 and 7.
Figure 9:
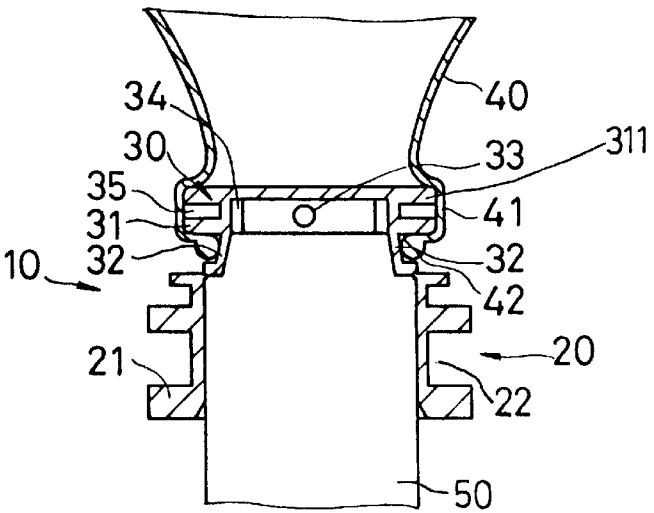
Figure 11:
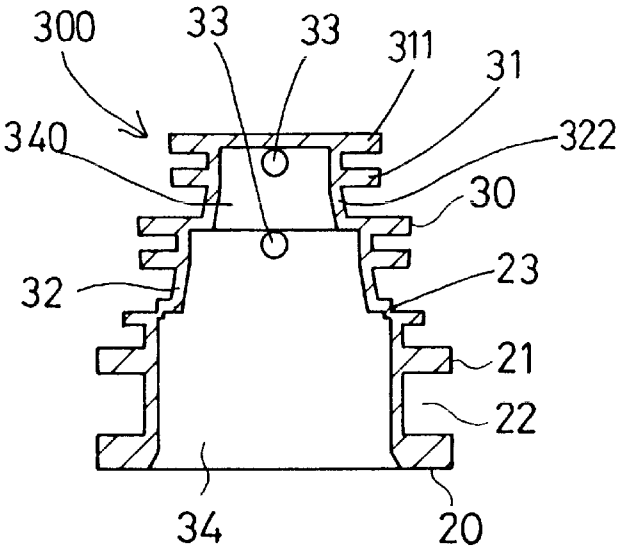
FIG. 11 is a cross sectional view taken along lines 11—11 of FIG. 10.
Figure 10:
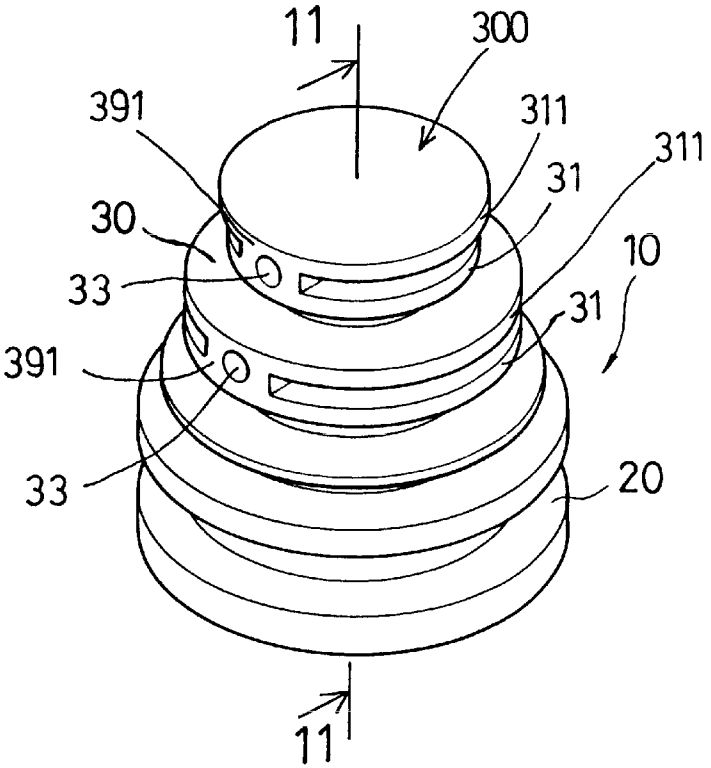
FIG. 10 is a perspective view illustrating a further embodiment of the balloon neck fitting.
Figure 13:
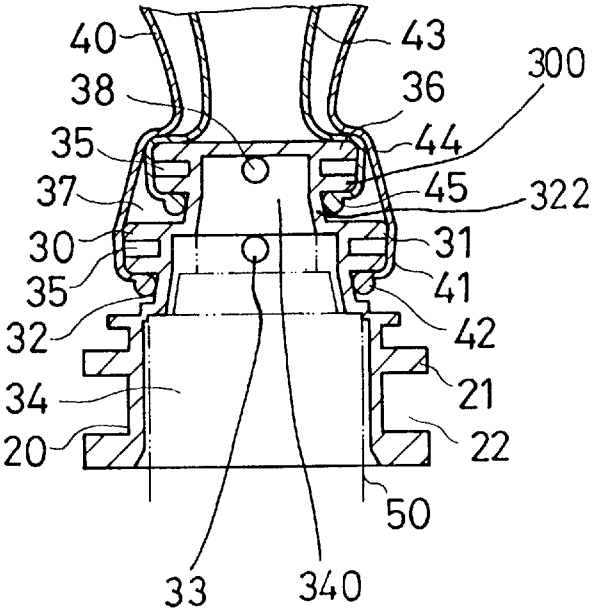
FIGS. 12 and 13 are cross sectional views similar to FIG. 11, illustrating the operation of the balloon neck fitting as shown in FIGS. 10 and 11.
Figure 12:
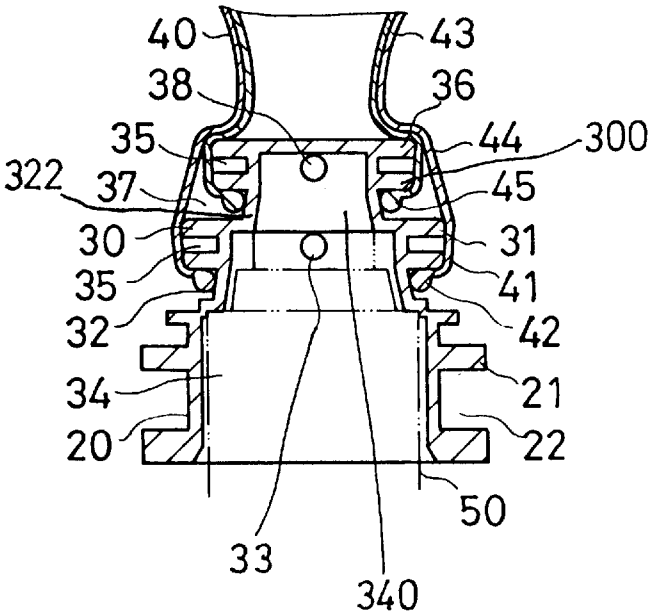
Figure 14:
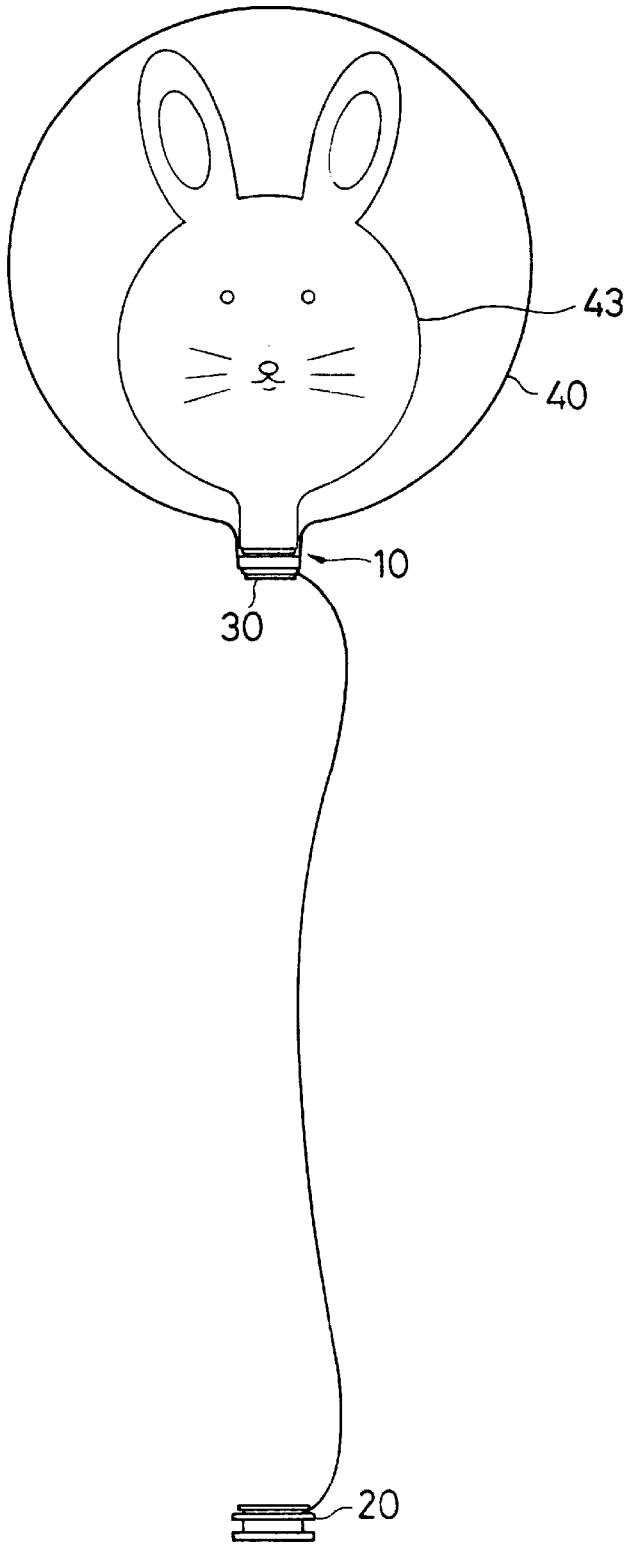
FIG. 14 is a plan schematic view illustrating the operation of the balloon neck fitting as shown in FIGS. 10–13.

In operation, as shown in FIG. 3, the air or the gas from the gas supplying nozzle 50 may be filled into the chamber 34 of the balloon neck fitting 10, and may be forced to flow through the orifices 33 of the extensions 391 and thus to flow into the balloon 40, in order to inflate the balloon 40. As shown in FIG. 4, after the balloon 40 has been inflated, the neck 41 of the balloon 40 is still clamped onto and solidly engaged with the outer or free ends of the extensions 391 and/or the peripheral rings 392 of the extensions 391, such that the air or the gas in the balloon 40 may be prevented from being leaked or flown out of the balloon 40. After the balloon 40 has been filled with air or gas, the check valve section 30 may be bent or disengaged from the base 20 by breaking the peripheral coupling member 23, for allowing the check valve section 30 to be disengaged from the base 20 as shown in FIG. 5.

Referring next to FIGS. 6–9, the check valve section 30 may further includes a peripheral flange or a board 311 laterally extended radially outward from the upper wall 39, or formed on top thereof and flush with the upper wall 39, for forming or defining a peripheral gap or channel 35 between the peripheral flange 31 and the board 311, and for further engaging with the neck 41 of the balloon 40 and for further making an air tight seal between the neck 41 of the balloon 40 and the check valve section 30. The peripheral board 311 includes an outer peripheral portion flush or aligned with the outer peripheral portion of the peripheral flange 31.

Referring next to FIGS. 10–14, the check valve section 30 may include a further housing 322 formed or provided on the upper portion of the housing 32, and having an outer size or outer diameter smaller than that of the housing 32. The housing 322 also includes a peripheral flange 31 and/or a peripheral board 311 extended radially outward therefrom, and one or more extensions 391 extended from the housing 322, and also includes a chamber 340 formed therein and communicating with the chamber 34 of the housing 32. A smaller or another balloon 43 may include a neck 44 engaged onto the peripheral flange 31 and/or the peripheral board 311 of the housing 322, and a greater balloon 40 may also include the neck 41 engaged with the peripheral flange 31 and/or the peripheral board 311 of the housing 32. The balloon 43 may thus be inflated and received within the balloon 40, best shown in FIG. 14.

Accordingly, the balloon neck fitting in accordance with the present invention includes a check valve section having a reduced contact area for engaging with the neck of the balloon and for preventing air or gas from leaking between the neck of the balloon and the check valve section, and for reducing the noise while filling air or gas into the neck of the balloon.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A balloon neck fitting comprising:

a check valve section including a peripheral housing having a middle portion, and having a peripheral flange extended radially outward from said middle portion thereof for engaging with a neck of a balloon.

said housing including a chamber formed therein, and including an upper portion having at least one extension extended outward therefrom, said at least one extension including an orifice formed therein and communicating with said chamber of said housing, and said at least one extension of said housing each including an outer end for engaging with the neck of the balloon, and said at least one extension of said housing including a peripheral ring formed on said outer end thereof for reducing a contact area with the neck of the balloon.

2. A balloon neck fitting comprising:

a check valve section including a peripheral housing having a middle portion, and having a peripheral flange extended radially outward from said middle portion thereof for engaging with a neck of a balloon, said housing including a chamber formed therein, and including an upper portion having at least one extension extended outward therefrom, said at least one extension including an orifice formed therein and communicating with said chamber of said housing, said housing including a peripheral board provided on top thereof, and spaced from said peripheral flange for forming a peripheral channel between said peripheral board and said peripheral flange, and said at least one extension of said housing each including an outer end for engaging with the neck of the balloon.

3. A balloon neck fitting comprising:

a check valve section including a peripheral housing having a middle portion, and having a peripheral flange extended radially outward from said middle portion thereof for engaging with a neck of a balloon, said housing including a chamber formed therein, and including an upper portion having at least one extension extended outward therefrom, said at least one extension including an orifice formed therein and communicating with said chamber of said housing, a base including an upper portion coupling to said housing with a coupling member, said coupling member being breakable for allowing said base to be disengaged from said housing, and said at least one extension of said housing each including an outer end for engaging with the neck of the balloon.

4. A balloon neck fitting comprising:

a check valve section including a peripheral housing having a middle portion, and having a peripheral flange extended radially outward from said middle portion thereof for engaging with a neck of a balloon, said housing including a chamber formed therein, and including an upper portion having a pair of extensions extended outward therefrom, said extensions each including an orifice formed therein and communicating with said chamber of said housing, and said extensions of said housing each including an outer end for engaging with the neck of the balloon.

5. The balloon neck fitting according to claim 4, wherein said extensions of said housing each includes a peripheral ring formed on said outer end thereof for reducing a contact area with the neck of the balloon.

6. The balloon neck fitting according to claim 4, wherein said housing further includes a peripheral board provided on top thereof, and spaced from said peripheral flange for forming a peripheral channel between said peripheral board and said peripheral flange.

7. The balloon neck fitting according to claim 4, further comprising a base including an upper portion coupling to said housing with a coupling member, said coupling member being breakable for allowing said base to be disengaged from said housing.

* * * * *